US009033030B2

(12) United States Patent
Des Champs

(10) Patent No.: US 9,033,030 B2
(45) Date of Patent: May 19, 2015

(54) APPARATUS AND METHOD FOR EQUALIZING HOT FLUID EXIT PLANE PLATE TEMPERATURES IN HEAT EXCHANGERS

(75) Inventor: Nicholas H. Des Champs, Las Vegas, NV (US)

(73) Assignee: MUNTERS CORPORATION, Selma, TX (US)

( * ) Notice: Subject to any disclaimer, the term of this patent is extended or adjusted under 35 U.S.C. 154(b) by 487 days.

(21) Appl. No.: 12/461,855

(22) Filed: Aug. 26, 2009

(65) Prior Publication Data

US 2011/0048687 A1 Mar. 3, 2011

(51) Int. Cl.

| | |
|---|---|
| ***F28D 7/02*** | (2006.01) |
| ***F28F 3/00*** | (2006.01) |
| ***F28F 13/00*** | (2006.01) |
| ***F28F 13/12*** | (2006.01) |
| ***F28F 3/04*** | (2006.01) |
| ***F28D 9/00*** | (2006.01) |
| ***F28F 13/08*** | (2006.01) |

(52) U.S. Cl.

CPC . *F28F 3/044* (2013.01); *F28D 9/00* (2013.01); *F28F 13/08* (2013.01)

(58) Field of Classification Search

CPC ..... F28F 19/006; F28F 3/00; F28F 3/04; F28F 3/044; F28F 13/06; F28F 13/08; F28F 17/00; F28D 9/00; F28D 9/0031; F28D 9/0037; F28D 9/02

USPC ..... 165/166, 109.1, 146, 903

See application file for complete search history.

(56) References Cited

U.S. PATENT DOCUMENTS

| | | | | | |
|---|---|---|---|---|---|
| 1,826,344 | A | * | 10/1931 | Dalgliesh | 165/170 |
| 2,306,526 | A | * | 12/1942 | Dalzell et al. | 29/890.042 |
| 2,959,400 | A | * | 11/1960 | Simpelaar | 165/166 |
| 3,291,206 | A | * | 12/1966 | Nicholson | 165/166 |
| 3,403,724 | A | * | 10/1968 | Gutkowski | 165/119 |
| 3,759,323 | A | * | 9/1973 | Dawson et al. | 165/166 |
| 4,044,820 | A | | 8/1977 | Nobles | |

(Continued)

FOREIGN PATENT DOCUMENTS

| | | | |
|---|---|---|---|
| CN | 1244913 | A | 2/2000 |
| CN | 1853081 | A | 10/2006 |

(Continued)

OTHER PUBLICATIONS

Jul. 3, 2013 Office Action issued in U.S. Appl. No. 13/365,602.

(Continued)

*Primary Examiner* — Allen Flanigan
*Assistant Examiner* — Jason Thompson
(74) *Attorney, Agent, or Firm* — Oliff PLC

(57) ABSTRACT

An apparatus and method for minimizing cold spots on plates of a plate-type fluid-to-fluid heat exchanger averages the plate temperature at a hot-fluid exit plane of the heat exchanger. The heat exchanger matrix is constructed to internally vary the flow patterns of opposing hot and cold fluid streams so that the heat transfer coefficient values of one or both fluid streams, designated as h, are optimized so the hot fluid value is a greater value than that of a cold fluid value. Plate variable flow structures are arranged in a manner that allows higher velocity hot fluid flow and possible lower velocity cold fluid flow in areas where the plate temperatures are coolest and the opposite configuration where plate temperatures are hottest.

24 Claims, 7 Drawing Sheets

(56) References Cited

U.S. PATENT DOCUMENTS

| | | | | |
|---|---|---|---|---|
| 4,049,051 | A * | 9/1977 | Parker | 165/166 |
| 4,243,096 | A | 1/1981 | Lipets et al. | |
| 4,569,391 | A * | 2/1986 | Hulswitt et al. | 165/166 |
| 4,611,652 | A | 9/1986 | Bernstein et al. | |
| 4,805,695 | A * | 2/1989 | Ishikawa et al. | 165/166 |
| 4,862,952 | A | 9/1989 | Tarasewich et al. | |
| 4,890,670 | A * | 1/1990 | Schiessl | 165/76 |
| 4,971,137 | A * | 11/1990 | Thompson | 165/276 |
| 5,036,907 | A * | 8/1991 | Leven | 165/54 |
| 5,060,722 | A | 10/1991 | Zdenek et al. | |
| 5,323,850 | A | 6/1994 | Roberts | |
| 5,937,519 | A | 8/1999 | Strand | |
| 5,947,812 | A | 9/1999 | Henning et al. | |
| 6,129,144 | A | 10/2000 | Bousquet | |
| 6,155,338 | A * | 12/2000 | Endou et al. | 165/165 |
| 6,161,535 | A | 12/2000 | Dempsey et al. | |
| 6,167,948 | B1 | 1/2001 | Thomas | |
| 6,167,952 | B1 | 1/2001 | Downing | |
| 6,183,879 | B1 | 2/2001 | Deeley | |
| 6,192,975 | B1 * | 2/2001 | Yanai et al. | 165/165 |
| 6,220,340 | B1 | 4/2001 | Cheong et al. | |
| 6,289,982 | B1 * | 9/2001 | Naji | 165/177 |
| 6,324,978 | B1 | 12/2001 | Kaulen et al. | |
| 6,357,396 | B1 | 3/2002 | Stansfield et al. | |
| 6,938,688 | B2 | 9/2005 | Lengauer, Jr. et al. | |
| 7,059,395 | B2 | 6/2006 | Bousquet et al. | |
| 7,073,573 | B2 * | 7/2006 | Agee | 165/146 |
| 7,104,312 | B2 | 9/2006 | Goodson et al. | |
| 2002/0003036 | A1 * | 1/2002 | Tsunoda et al. | 165/166 |
| 2002/0005280 | A1 * | 1/2002 | Wittig et al. | 165/166 |
| 2002/0017382 | A1 | 2/2002 | Nakado et al. | |
| 2004/0112585 | A1 | 6/2004 | Goodson et al. | |
| 2005/0274501 | A1 | 12/2005 | Agee | |
| 2006/0231241 | A1 | 10/2006 | Papapanu et al. | |
| 2007/0107889 | A1 * | 5/2007 | Zaffetti et al. | 165/166 |
| 2007/0248866 | A1 | 10/2007 | Osenar et al. | |
| 2008/0023179 | A1 * | 1/2008 | Bunker et al. | 165/109.1 |
| 2009/0087355 | A1 | 4/2009 | Ashe | |

FOREIGN PATENT DOCUMENTS

| | | |
|---|---|---|
| JP | A-64-054196 | 3/1989 |
| JP | A-04-055634 | 2/1992 |
| JP | A-06-123589 | 5/1994 |
| JP | A-06-123590 | 5/1994 |
| WO | WO 2007/122167 A1 | 11/2007 |

OTHER PUBLICATIONS

Nov. 6, 2013 Office Action issued in U.S. Appl. No. 13/365,602.
Mar. 28, 2013 Office Action issued in U.S. Appl. No. 13/365,602.
Jul. 3, 2014 Office Action issued in U.S. Appl. No. 13/365,602.
Apr. 28, 2014 Office Action issued in European Patent Application No. 10 173 358.2.
Jan. 15, 2014 Office Action issued in Chinese Patent Application No. 201010272874.4 (with English Translation).

* cited by examiner

CROSS-FLOW SENSIBLE PLATE HEAT EXCHANGER

APPARATUS AND METHOD FOR EQUALIZING HOT FLUID EXIT PLANE PLATE TEMPERATURES IN HEAT EXCHANGERS

BACKGROUND

Exemplary embodiments of an apparatus and method for equalizing hot fluid exit plane plate temperatures relate to plate-type fluid-to-fluid heat exchangers. More specifically, the embodiments relate to heat exchangers constructed to minimize deleterious effects attributable to cold spots on plates that form a heat exchanger matrix.

A fluid-to-fluid heat exchanger matrix is designed to extract energy from, for example, hot exhaust gas. As the hot gas stream proceeds through the matrix, a cooler opposing gas stream draws thermal energy from the hot gas stream across intervening plates and cools the hot gas stream. Accordingly, toward the end of the hot gas flow path, i.e. the hot gas exit plane, the temperature of the hot gas is low as it comes into contact with a metal surface of a plate that separates incoming cooler gas from the exiting cooled hot gas. At the hot gas exit plane, the plate temperature may be low due to close proximity to the cool gas entry plane. When the hot gas contacts cool or low temperature portions of the metal plate separating the two gas streams, a dew point temperature of hot gas constituents may be reached, and condensation may occur. Thus, when corrosive constituents are present in the gas streams, corrosive condensation or fouling due to particulate accumulation may cause premature failure of the heat exchanger matrix.

An ideal fluid-to-fluid heat exchanger (hereinafter a gas-to-gas heat exchanger by way of example only) should cool hot process gas to a temperature that merely approaches the dew point temperature of corrosive constituents so that the hot gas exits the heat exchanger matrix without first condensing the constituents on a cold spot near the hot gas exit plane, or any portion of a plate of the heat exchanger matrix. Heat exchangers generally do not accommodate true counterflow of hot and cool gas streams and therefore hot process gas, at a plane perpendicular to gas flow, does not cool evenly as it progresses through and exits the heat exchanger matrix. Thus, cold spots may form on plates of the heat exchanger matrix.

SUMMARY

There are known approaches for minimizing the potential for cold spots on heat exchanger plates. One approach is to use a parallel flow heat exchanger. This approach does not, however, optimize the amount of heat transferred for the surface area of the heat exchanger matrix. For example, for equal mass flow and equal heat capacity of two gas streams in a parallel flow heat exchanger, the maximum theoretical recovery efficiency is 50%.

Another approach is to design a "true" counterflow heat exchanger having a theoretical recovery efficiency of 100%. This is not practical, however, because the complexity and cost associated with a manifold construction that would allow two gas streams to enter and exit channels between plates in a counterflow manner is prohibitive.

Due to economics of manufacture, gas-to-gas heat exchangers used today are of a crossflow or quasi-counterflow design. Unless special design procedures are used, heat exchanger matrix plate temperatures near the hot gas exit plane (and cold gas exit plane) may exhibit temperatures lower than other points on the plates. In order to achieve optimal heat transfer and at the same time avoid condensation at a localized cold area near the hot fluid exit plane of a plate, yet another approach for reducing the influence of incoming cold gas on plate temperature is to thermally insulate part of the heat exchanger plates. Insulation technology may be used to increase the metal plate temperature in a cold corner of the plate at the hot gas exit plane, resulting in condensation-free operation. However, this technique may result in added costs and wasted heat exchanger surface area.

A typical plate-type gas-to-gas heat exchanger matrix is shown in FIG. 1. Hot gas (represented by arrows 140) enters at the top of the matrix at a temperature T3 of, for example, 1000° F., and exits at the bottom of the matrix. Cooling gas enters the matrix at a cool gas entry plane 175 on a side of the matrix adjacent to its bottom (represented by arrow T1) and exits the matrix on a side of the matrix adjacent to its top (represented by arrow T2). At the hot gas exit plane 100, a varying temperature distribution exists due to leaving hot gas 150 (cooled hot gas). At plate point 150*a*, the temperature of the leaving hot gas is lowest, 450° F. For the distance between each plate point 150*b*, 150*c* and 150*d*, the temperature of the leaving hot gas 150 increases by about 100° F., respectively. At plate point 100, the temperature of the leaving hot gas 150 is 800° F. While the average temperature of leaving hot gas 150 is 650° F., the deviation among temperatures of leaving hot gas 150 at plate points 150*a*-150*d* is significant. Plate point 150*a*, the point at which the temperature of the leaving hot gas 150 is lowest, is also near the cool gas entry plane 175 of the heat exchanger matrix. The applicant has discovered that it is desirable to have substantially equal metal plate temperatures at plate points 150*a*-150*d*. This allows for maximum heat transfer without condensation on the plates, and concomitant corrosion and/or fouling due to particulate accumulation.

Plate temperature is affected by the temperature of the hot and cool gas streams adjacent to an intervening plate, and the heat transfer coefficients of each gas stream at the same x, y coordinates on opposing surfaces of the plate. This relationship is derived from the general equation for heat transfer:

$$U=1/(1/h_1+f_1+t/k+f_4+1/h_4)$$

$$h\approx Re^{0.8}=(\rho VD_h/\mu)^{0.8}$$

$$h=f[Re^{0.8}Pr^{0.3}]$$

$$Re=\rho VD_h/\mu$$

$Q$=heat transferred

A=area

ΔT=temperature difference between the hot gas and the cold gas at a point on the transfer plate U=overall conductance $h_1$=cold gas heat transfer coefficient, btu/(hr ft$^2$° F.)

$f_1$=cold gas fouling factor t/k=metal thickness divided by the metal thermal conductivity $f_4$=hot gas fouling factor $h_4$=hot gas heat transfer coefficient, btu/(hr ft$^2$° F.)

Re=Reynolds Number

ρ=gas density, lb/ft$^3$

V=velocity of gas, ft/hr $D_h$=hydraulic diameter of flow channel, ft

μ=viscosity of gas, btu/(hr ft ° F.)

Cp=specific heat of gas, btu/(lb ° F.)

k=thermal conductivity of gas, btu/(hr ft ° F.)

Thus, the velocity V is the only parameter that can be varied in any degree with given inlet flow conditions. In other words, in view of the foregoing, it may be stated that the heat transfer coefficient h varies with velocity, e.g., $h \sim V^{0.8}$. The temperature of a point on a plate in a heat exchanger matrix may be influenced by manipulating the velocity V of the process gasses at locations throughout the matrix. The heat exchanger embodiments described herein accomplish this by varying the spacing between protrusions, or variable flow structures, on plates within the matrix. Variable flow structures may be formed during the manufacturing process to maintain desired gas flow by way of spacing between heat transfer plates. The variable flow structures may be protrusions that are defined in the matrix design by a protrusion height and protrusion spacing, i.e., the distance between the protrusions when stamped on the metal plate.

An increase in hot gas velocity at a given plate point, all other parameters remaining constant, results in an increase in heat transfer coefficient $h_4$ of the hot gas and thus an increase in the plate temperature at that point. Therefore, the variable flow structures of a plate may be arranged or patterned to affect gas velocity at different plate points and thereby optimize the values of $h_4$ (and possibly $h_1$) and equalize to an extent the plate temperatures at points at or near the hot gas exit plane and elsewhere on plates of the matrix.

Specifically, variable flow structures may be arranged on plates within the matrix so as to increase a velocity of hot gas flow and possibly lower a velocity of a cold gas flow at plate points that are normally cooler. The opposite configuration may be used at plate points where the plate would normally be hotter. When hot gas flow velocity increases and thus the hot gas heat transfer coefficient increases, the metal plate temperature may be influenced more by the hot gas temperature than that of the opposing cold gas stream. Conversely, a decreased velocity cold gas flow may cause the metal plate temperature to be less influenced by the cold gas temperature. Therefore, at a lowest temperature point on the plate, it may be advantageous to increase the hot gas flow velocity to optimize $h_4$, and perhaps reduce the cold gas flow velocity to optimize $h_1$, to thereby cause the metal temperature to increase.

Variable flow structures on a surface of a plate facing a hot gas stream may also be arranged so that an artificial flow resistance forces hot gas to an area where the cold gas enters the heat exchanger. Conversely, variable flow structures on a surface of a plate facing a cold gas stream may be arranged so that an artificial flow resistance forces cold gas away from portions of a plate that exhibit cold spots.

Exemplary embodiments are described herein. However, it is envisioned that any heat exchanger arrangement that may incorporate the features of the method and apparatus for minimizing cold spots in the plates of a plate-type gas-to-gas heat exchanger described herein are encompassed by the scope and spirit of the exemplary embodiments.

EMBODIMENTS

Figure 1:
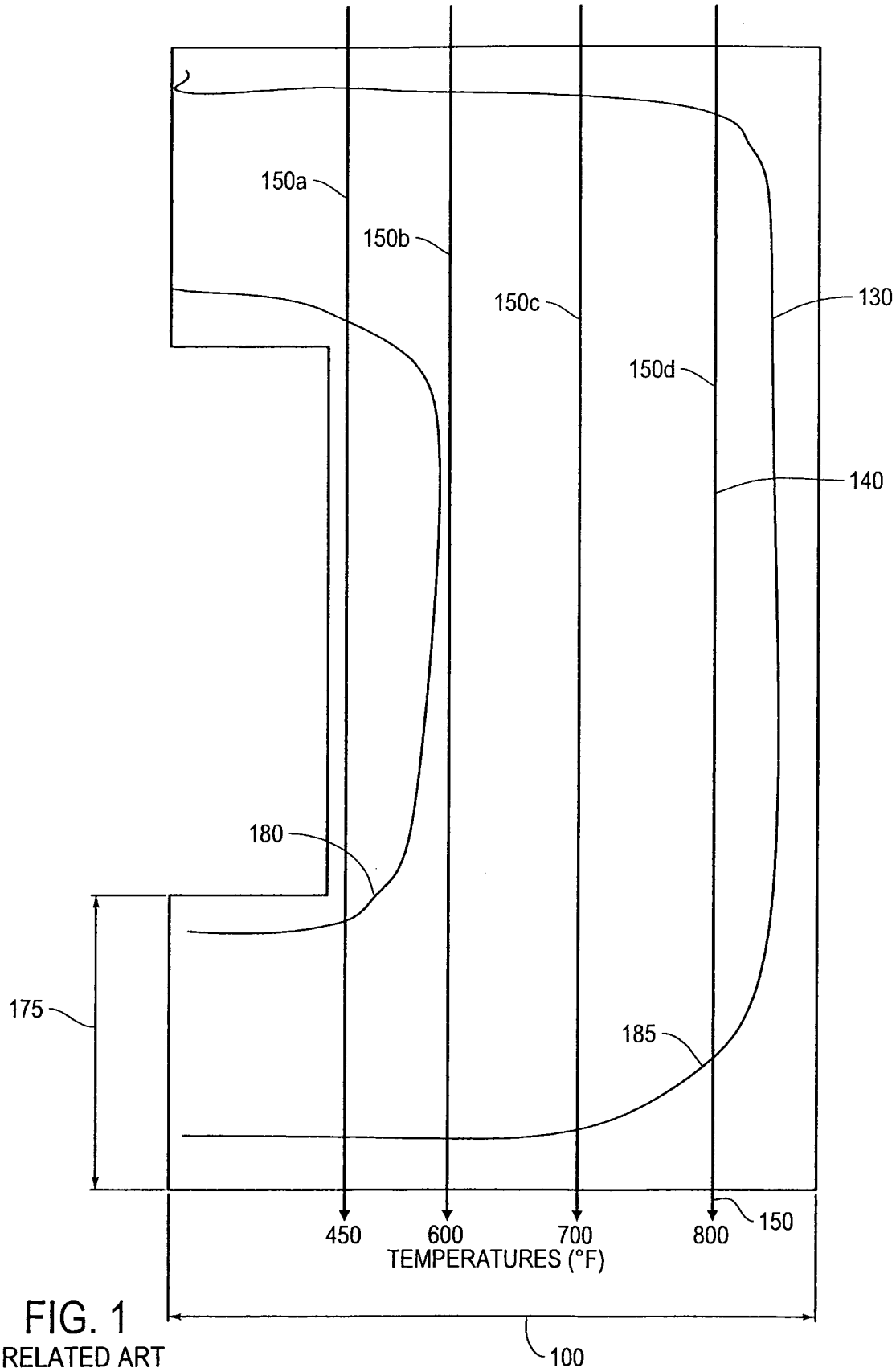
FIG. 1 RELATED ART
FIG. 1 shows a diagrammatical cross-sectional view of a heat exchanger matrix plate in accordance with the related art and hot gas exit plane gas temperatures.

The exemplary embodiments are intended to cover all alternatives, modifications and equivalents as may be included within the spirit and scope of the method and apparatus as defined herein.

For an understanding of an apparatus and method for equalizing hot gas exit plane plate temperatures to minimize cold spots on plates of gas-to-gas heat exchanger matrices, reference is made to the drawings. In the drawings, like referenced numerals have been used throughout to designate similar or identical elements. The drawings depict various embodiments and data related to embodiments of illustrative heat exchangers incorporating features of exemplary embodiments described herein.

FIG. 1 shows a related art plate-type heat exchanger wherein the h values of cold gas stream 130 and hot gas stream 140 are not optimized and thus the metal plate temperature is uneven at hot gas exit plane 100. Specifically, the metal temperature at plate points 150*a*-150*d* deviate from one another substantially.

Figure 2:
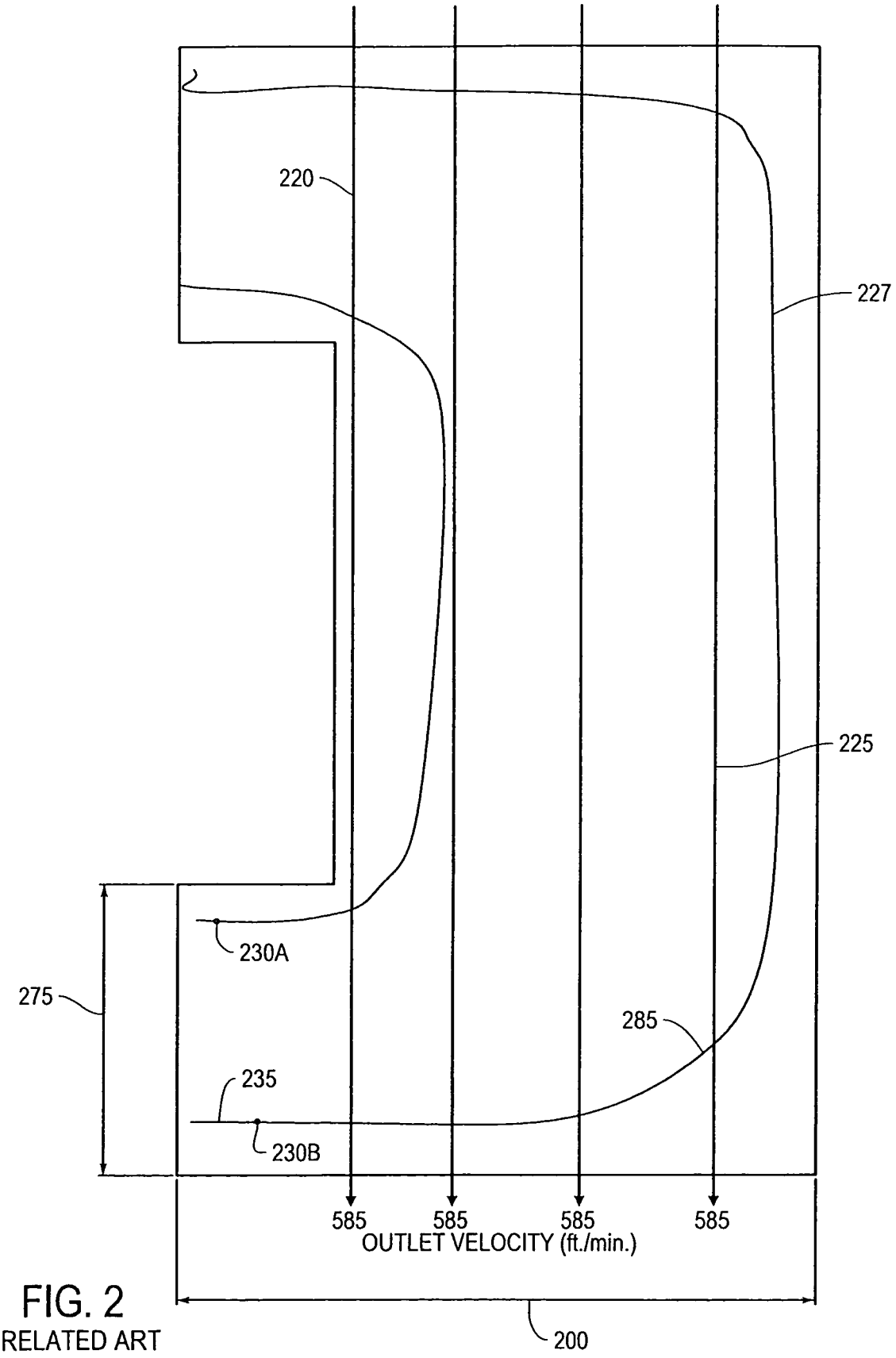
FIG. 2 RELATED ART
FIG. 2 shows a diagrammatical cross-sectional view of the heat exchanger plate shown in FIG. 1 and gas velocities.

Related art plates of the type shown in FIG. 1 typically have symmetrical variable flow structure arrangements. FIG. 2 shows a diagrammatical cross-sectional view of the heat exchanger plate shown in FIG. 1. Instead of temperatures of leaving hot gas as shown in FIG. 1, FIG. 2 shows velocities of hot gas (represented by arrows 225) near or at hot gas exit plane 200, and velocities of entering cool gas 235, and specifically velocities of entering cool gas 235 at plate points 230*a* and 230*b* near or at the cool gas entry plane 275.

At the cool gas entry plane 275, cold gas stream 235 has a high velocity causing the plates to be coldest near cool gas entry plane 275 where a blast of cold air enters the heat exchanger. As shown in FIG. 2, cool gas stream 235 has a velocity at plate point 230*a* of about 1000 ft/min, while the velocity of the cool gas stream 235 at plate point 230*b* is about 470 ft/min.

Contrarily, the velocity of the exiting hot gas stream 225 may be relatively even across the vicinity of the hot gas exit plane 200, the velocity being about 585 ft/.in. If the cool gas stream 235 has a higher velocity at a plate point than does the hot gas stream 225, then the plate temperature may be influenced more by the cool air stream 235 and its temperature. Thus, and as shown in FIG. 1, the exiting hot gas 150 may have a temperature that varies from a low near the vicinity of the cool air entry plane to a high at a portion of the plate distal to the cool air entry plane 175. Indeed, FIG. 1 shows declining exiting hot gas 150 temperatures from plate points 150*d* through 150*a* approaching the cool gas entry plane 175, plate point 150*d* being distal to cool gas entry plane 175.

Spacing between the plates of a heat exchanger matrix may be defined by dimples, or other variably shaped protrusions (collectively referred to herein as variable flow structures), formed on the plates with a height that is typically half of the spacing between the plates. The dimples on opposing plates contact one another to define the plate spacing and provide structural support. That is, for a half-inch plate spacing, the dimple height on each plate would be a quarter inch.

A variable flow structure pattern on a plate may be selected for the purpose of: (1) supporting the plates to withstand a pressure differential between the fluid streams to prevent the plates from collapsing onto one another as a result of high gas pressure; (2) increasing flow turbulence to enhance h; (3) decreasing turbulence to lower gas flow pressure drop; or (4) a combination of 1, 2 and 3 to control temperature and overall performance. While protrusions or dimples are discussed as exemplary variable flow structures, any structure that varies the velocity of an adjacent gas stream may constitute a variable flow structure in accordance with an exemplary embodiment.

A related art heat exchanger has plates with dimples or protrusions that may be equally spaced or symmetrical, and may exhibit velocities and plate temperatures as shown in FIGS. 1 and 2. As discussed above, the hot gas temperature varies from a low at the cold gas entrance plane 175 to a high at the side opposite the inlet, e.g., plate point 150*d*. As shown in FIGS. 1 and 2, the hot gas streams have substantially equal velocity through the entire length of the heat exchanger because the dimples on the hot side are evenly spaced and arranged symmetrically over the entire plate surface. The cold gas streams are typically in a "U-flow" pattern and have differing velocities, a highest velocity corresponding to the shortest flow length and a lowest velocity corresponding to the longest flow length. The velocity relationship between the flow streams when the dimples are evenly spaced as in the related art may be expressed as follows:

$$V12b=\text{sqrt}[(L12a\backslash L12b)\times V12a].$$

FIG. 2 shows that the velocity of cool gas flow stream 180 of FIG. 1 (corresponding to flow stream 235 at plate point 230*a*) is more than two times the velocity of cool gas flow stream 185 of FIG. 1 (corresponding to flow stream 235 at plate point 230*b*). The cool gas has a greater influence on plate temperature along flow stream 180's path than along flow stream 185, and thus a lower exiting hot gas temperature (e.g., 450° F. at plate point 150*a*) nearest the cool gas entry plane 175, as shown in FIG. 1. Cool gas flow stream 185 has the opposite effect. Because the velocity of flow stream 185 at a plate point is less than that of the hot gas on the opposite side of the plate at that point, the hot gas is cooled less than that of the hot gas flow stream 228 near the cold-air inlet and thus hot gas flow stream 227 leaves the heat exchanger at a higher temperature (e.g., 800° F. at plate point 150*d*) and affects the surrounding plate temperature accordingly.

Because the value of h of a gas stream near the surface of the plate that separates two gas streams has a direct influence on the temperature of the plate at a given location, the temperature of the plate can be controlled to a degree by designing the variable flow structure pattern to influence gas flow distribution, and thus velocity throughout the heat exchanger. As discussed above, the higher the velocity of a gas stream, the higher the value of coefficient h of the gas stream. If $h_4$ of the hot gas is greater than $h_1$ of the cold gas, then the plate is influenced more by the hot gas stream temperature. Thus, as the heat transfer coefficient is changed, an effect on plate temperature, Tp may be observed. The relationship may be expressed as follows:

$$h_1Tp-h_1Tc=h_4Th-h_4Tp$$

$$Tp(h_1+h_4)=h_1Tc+h_4Th$$

$$Tp=(h_1Tc+h_4Th)/(h_1+h_4).$$

It is possible to calculate a variable flow structure arrangement that may change the velocity distribution of one or both of the cold gas stream and the hot gas stream in a manner that may optimize their values of h to effect a metal temperature that evens out at the hot gas exit plane.

Figure 3:
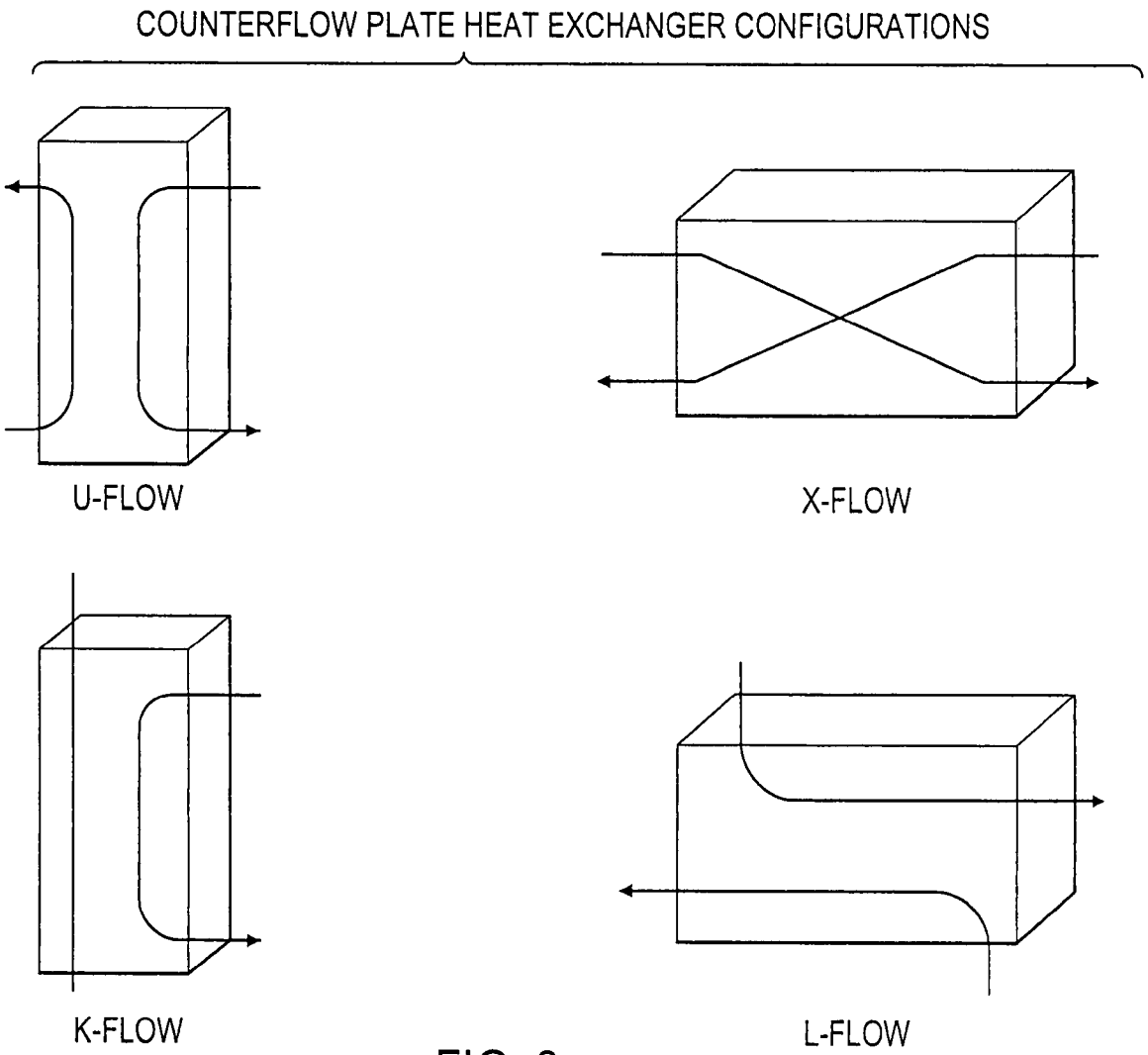
FIG. 3 shows counterflow heat exchanger configurations for use in an exemplary embodiment.

While a counterflow plate heat exchanger configuration wherein cold gas streams are typically in a "U-flow" pattern are discussed by way of example, it will be appreciated that the features and functions disclosed herein may be desirably combined into various heat exchanger configurations. For example, FIG. 3 shows counterflow plate heat exchanger configurations in accordance with exemplary embodiments. Variable flow structure arrangements may be applied in heat exchanger configurations other than "U-flow" such as "X-flow," "K-flow," and "L-flow." These configurations are mentioned by way of example. Likewise, it will be appreciated that species of both counterflow and crossflow configurations may be used.

Figure 4:
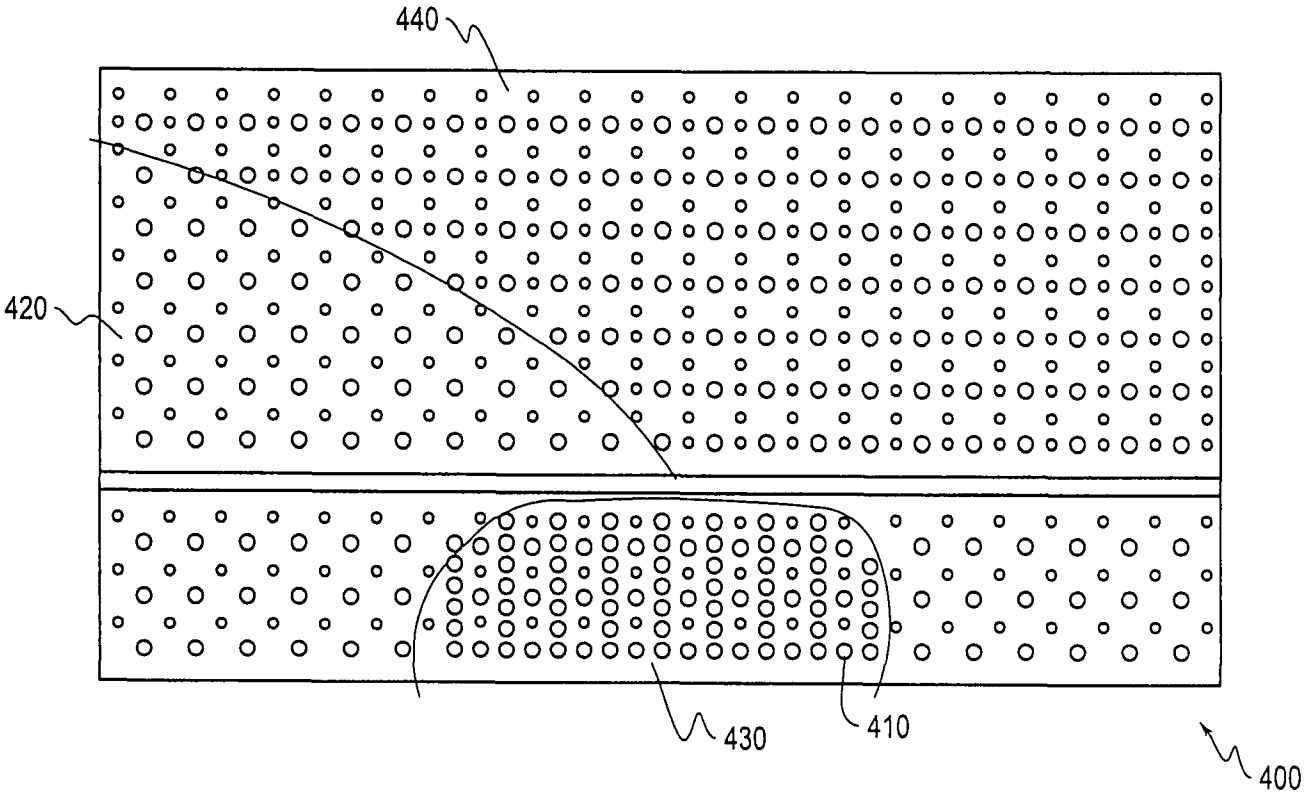
FIG. 4 shows a cold gas flow channel plate surface having a variable flow structure pattern in accordance with an exemplary embodiment.

FIG. 4 shows a plate surface facing a cold gas stream having a preferred arrangement of protrusions or dimples, i.e., variable flow structures 410. A heat exchanger matrix in accordance with an exemplary embodiment may include a plate surface facing a cold gas stream having a variable flow structure arrangement that is symmetrical while a plate surface facing a hot gas stream has a variable flow structure arrangement arranged to optimize $h_4$ of the hot gas stream.

The preferred variable flow structure arrangement of a plate surface facing a cold gas stream shown in FIG. 4 may effect idealized plate temperature, and may cause the h values of the hot and cold fluid streams to approach each other in value at any given x, y plate coordinate, thus increasing the overall performance of the heat exchanger. In other words, overall conductance U, has a greater average value in matrices having plates with variable flow structures 410 arranged in accordance with an exemplary embodiment than matrices having plates with substantially symmetrical variable flow structure spacing. This results in less surface area being required in the heat exchanger to produce the same thermal performance, or conversely, for the same surface area the overall effectiveness of the heat exchanger matrix increases. The overall pressure drop, even with the increased performance, remains essentially unchanged. Although uneven variable flow structure 410 spacing may lead to greater turbulence and greater pressure drop, this may be offset by greater plate spacing (less plates) to achieve the same effectiveness.

The exemplary cold side plate surface 400 shown in FIG. 4 embodies a variable flow structure 410 pattern that is asymmetrical and achieves the advantages discussed immediately above. For example, portion 440 of plate 400 has variable flow structures 410 arranged with a spacing between the variable flow structures 410 that is substantially equal throughout portion 440. However, the density of variable flow structures 410 differs between portions 420, 430, and 440. For example, the spacing between variable flow structures 410 of portion 420 of plate 400 is much greater than the spacing between variable flow structures 410 of portion 430 of plate 400.

Figure 5:
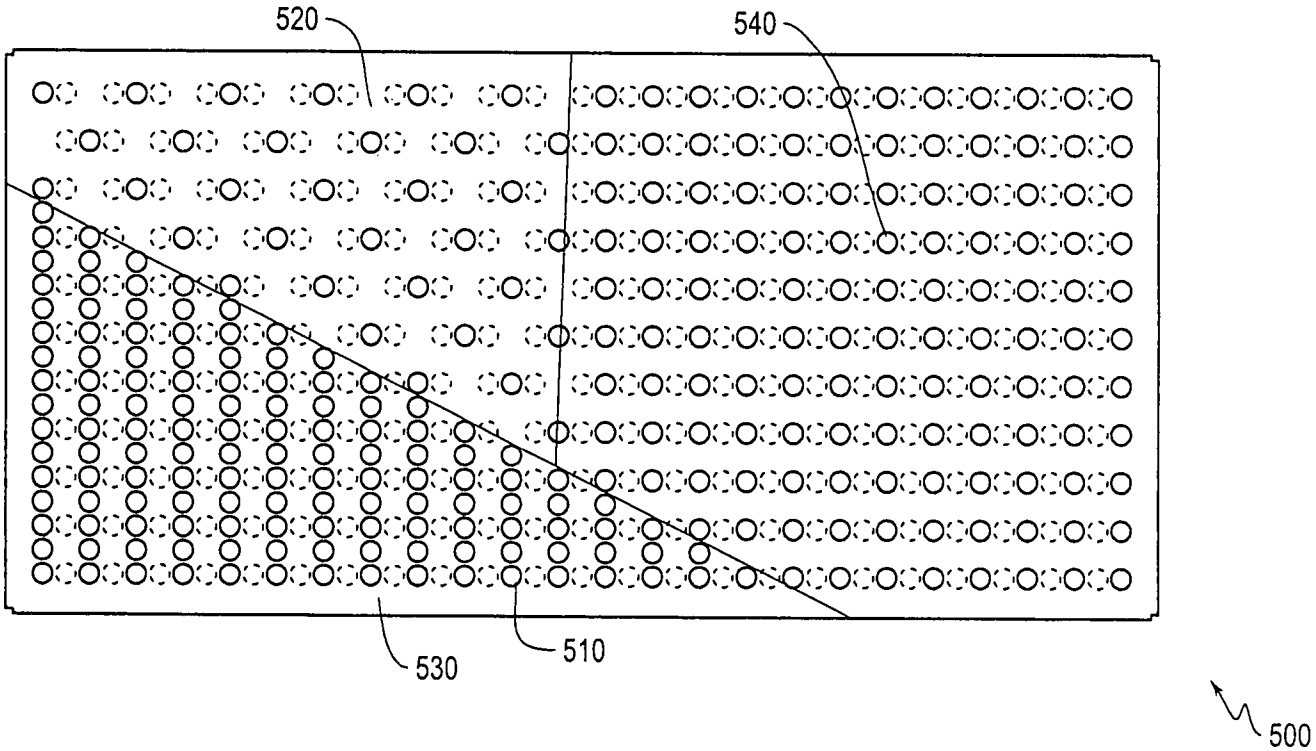
FIG. 5 shows a hot gas flow channel plate face having a variable flow structure pattern in accordance with an exemplary embodiment.

Similarly, FIG. 5 shows a preferred pattern arrangement of variable flow structures 510 of a plate surface facing a hot gas stream. FIG. 5 shows that the variable flow structures 510 of plate 500 may have different spacing therebetween among different portions of plate 500. For example, in an exemplary embodiment, spacing between variable flow structures 510 in portion 540 may be substantially equal throughout portion 540. However, the density of variable flow structures 510 of portion 520 may be substantially less than that of the variable flow structures 510 of portion 540, i.e., spacing between variable flow structures 510 of portion 520 may be greater than that of portion 540. Similarly, the variable flow structure 510 density in portion 530 of plate 500 may be greater than that of portions 540 and 520.

A heat exchanger having one or both of the variable pattern plate surfaces shown in FIGS. 4 and 5 may effect a change in velocity of hot and cold gases to optimize the values of h for either or both the hot and cold gases to result in a metal temperature that is substantially even across plate points at or near a hot gas exit plane.

Figure 6A:
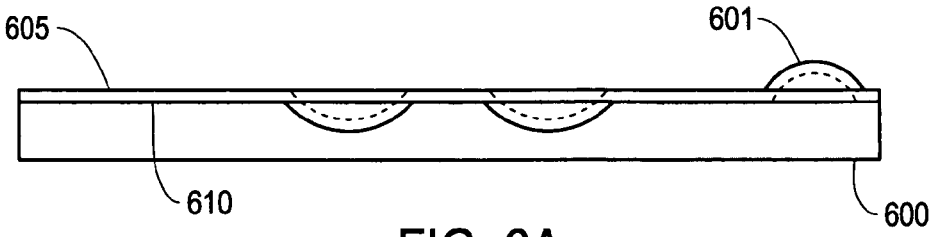
FIGS. 6A and 6B show side views of a plate having a variable flow structure pattern in accordance with an exemplary embodiment.
Figure 6B:
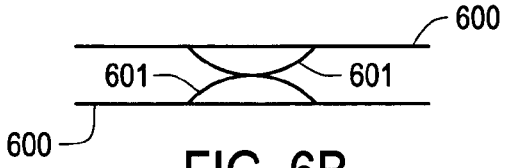

FIG. 6 shows a side view of a plate having a variable flow structure pattern in accordance with an exemplary embodiment. From FIG. 6 it may be understood that variable flow structures 601 may be arranged on plate 600 such that variable flow structures 601 are arranged on a first surface 605 of plate 600 that may face a hot gas stream. Variable flow structures 601 may also be arranged on a second surface 610 of plate 600 that may face a cold gas stream. Thus, surfaces 605 and 610 may be formed on or defined by a single plate 600. Moreover, variable flow structures 601 may be formed on both surfaces 605 and 610 of a single plate 600. Thus, during manufacture, variable flow structures 601 may be formed from or on the same plate 600.

Figure 7:
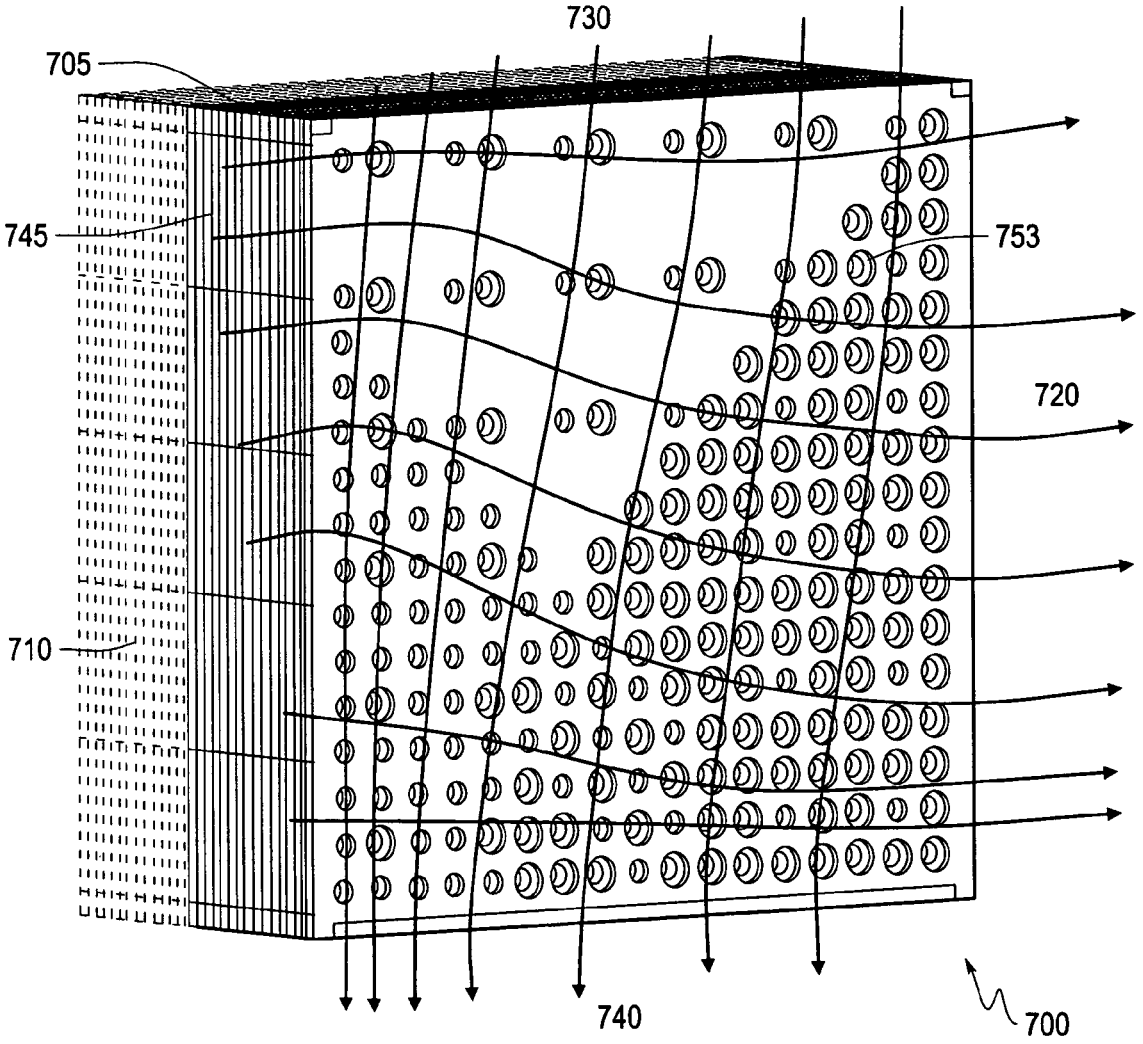
FIG. 7 shows a cross-sectional perspective view of a portion of a heat exchanger matrix in accordance with an exemplary embodiment.

FIG. 7 shows a cross-sectional perspective view of a crossflow heat exchanger in accordance with an exemplary embodiment. Crossflow heat exchanger 700 may include a heat exchanger matrix 705 in accordance with an exemplary embodiment, including plates having variable flow structure patterns as described above. Specifically, crossflow heat exchanger 700 may have a cold gas flow stream inlet 710 and a corresponding cold gas flow stream outlet 720 where cold gas may enter and exit the heat exchanger matrix. Crossflow heat exchanger 700 may include a hot gas flow stream inlet 730 and a corresponding hot gas flow stream outlet 740. Plates 745 may be arranged to form a matrix 750. At least one plate 745 may include variable flow structures 753 arranged in a pattern that affects the velocity of flow streams passing over plate 745. For example, a varying density of variable flow structures 753 across plate 745 may affect the direction of and velocity of an adjacent gas flow stream and correspondingly affect the value of h for the flow stream. As the value of h is optimized by way of the variable structure 753 pattern arrangement, the occurrence of cold spots on plate 745 may be reduced as the temperature of plate 745 across, for example, hot gas flow stream outlet 740 is made substantially even.

Figure 8:
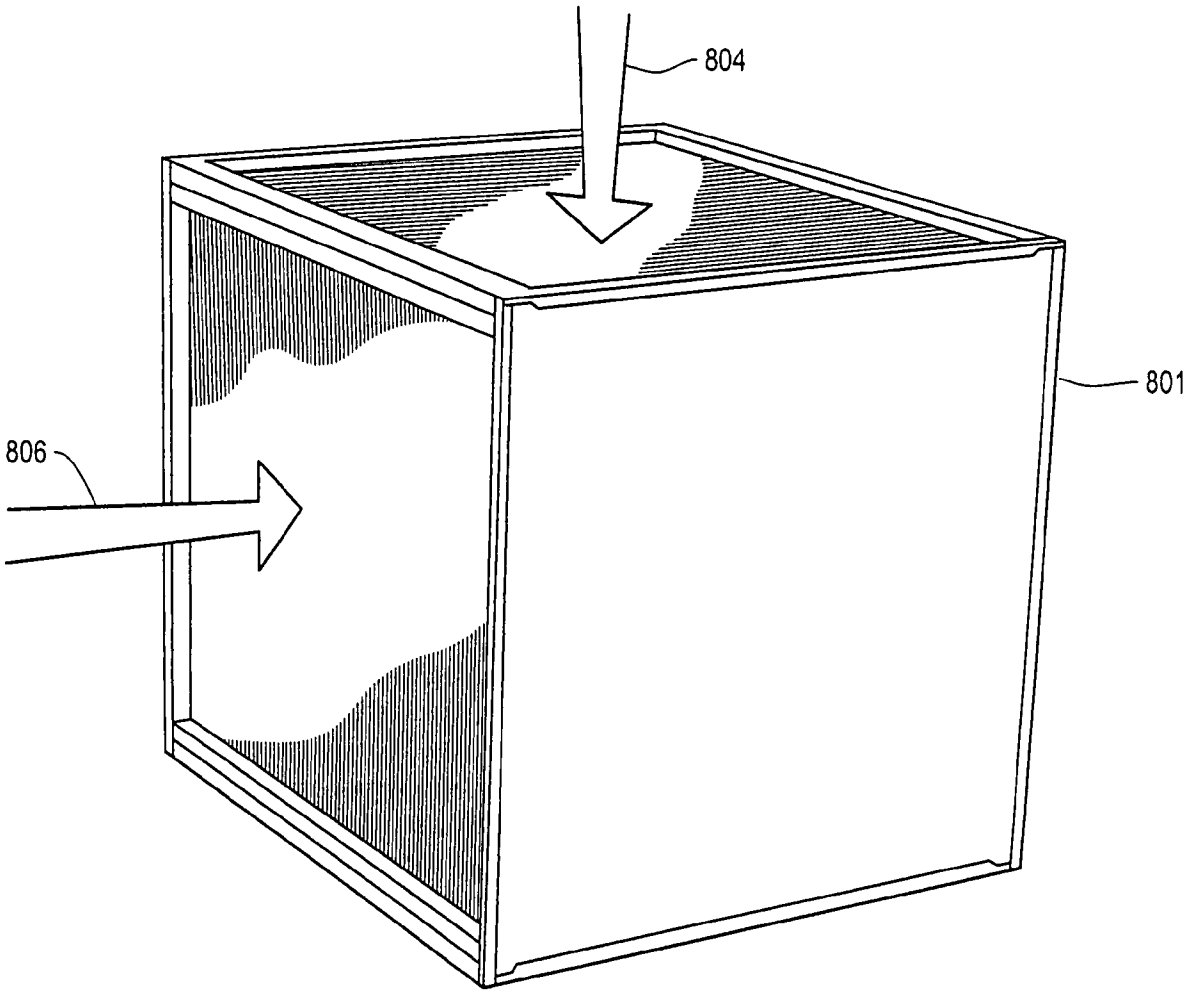
FIG. 8 shows a perspective view of a crossflow heat exchanger having a matrix in accordance with an exemplary embodiment.

FIG. 8 shows a perspective view of a crossflow heat exchanger 800. Specifically, FIG. 8 shows a crossflow heat exchanger 800 that may include the matrix shown in FIG. 7 in accordance with an exemplary embodiment. Crossflow heat exchanger 800 may include a hot gas flow stream inlet 804 that may accommodate a hot gas flow in a first direction. Crossflow heat exchanger 800 may also include a cold gas flow stream inlet 806 that may accommodate cold gas flow in a second direction substantially perpendicular to the first direction of the hot gas air flow. An alternative embodiment may include a counterflow heat exchanger, as discussed above, without departing from the scope and spirit of the exemplary embodiments.

While minimization of cold spots on plates of a plate-type gas-to-gas heat exchanger by optimizing the heat transfer coefficients of process gas streams has been described in relation to specific embodiments, it is evident that many alternatives, modifications, and variations will be apparent to those skilled in the art. Accordingly, embodiments of the method and apparatus as set forth herein are intended to be illustrative, not limiting. There are changes that may be made without departing from the spirit and scope of the exemplary embodiments.

It will be appreciated that the above-disclosed and other features and functions, or alternatives thereof, may be desirably combined into many other different systems or applications. Also, various presently unforeseen or unanticipated alternatives, modifications, variations, or improvements therein may be subsequently made by those skilled in the art, and are also intended to be encompassed by the following claims.

What is claimed is:

1. A fluid-to-fluid heat exchanger matrix comprising:

a first plate having a first surface and a second surface;

a second plate having a first surface and a second surface, the second surface of the first plate opposing the first surface of the second plate to define a first flow channel that accommodates passage of a relatively hot fluid;

a third plate having a first surface opposing the second surface of the second plate to define a second flow channel that accommodates passage of a relatively cold fluid; and the first plate, the second plate and the third plate comprising a portion of a plate matrix, wherein the matrix has a first flow inlet and a first flow outlet in communication with the first flow channel, and a second flow inlet and a second flow outlet in communication with the second flow channel;

a first section of the plate matrix is defined by a first half of the first flow channel upstream along a flow direction of the relatively hot fluid;

a second section of the plate matrix is defined by a second half of the first flow channel downstream along the flow direction of the relatively hot fluid;

a third section of the plate matrix is defined by a first half of the first section that is downstream along the flow direction of the relatively cold fluid; and a fourth section of the plate matrix is defined by a second half of the first section that is upstream along the flow direction of the relatively cold fluid, wherein a density of a plurality of flow structures in the second section is greater than a density of a plurality of flow structures in the first section and a density of the plurality of flow structures in a third section gradually increases along the flow direction of the hot fluid.

2. The fluid-to-fluid heat exchanger matrix according to claim 1 further comprising:

a plurality of flow structures in the second flow channel.

3. The fluid-to-fluid heat exchanger matrix according to claim 1, wherein the densities of the plurality of flow structures of the first flow channel and the plurality of flow structures of the second flow channel change the velocity of the hot fluid and the cold fluid, respectively, to optimize a heat transfer coefficient of one of the hot fluid and the cold fluid such that a temperature of the second plate is substantially equal across the second flow outlet.

4. The fluid-to-fluid heat exchanger matrix according to claim 1, wherein the plurality of flow structures of the first flow channel and the plurality of flow structures of the second flow channel are configured to control the velocity of the hot fluid and the cold fluid, respectively, to optimize a heat transfer coefficient of one of the hot fluid and the cold fluid such that a temperature of the second plate is controlled to minimize an occurrence of a cold point across the second flow outlet.

5. The fluid-to-fluid heat exchanger matrix according to claim 1, wherein some of the plurality of flow structures of are protrusions on the second surface of the first plate and some of the plurality of flow structures are protrusions on the first surface of the second plate in the first flow channel, and wherein some of the plurality of protrusions of the second plate contact some of the plurality of protrusions of the first plate, whereby the matrix is structurally supported.

6. The fluid-to-fluid heat exchanger matrix of claim 1, wherein the first plate further comprises:

a first portion and a second portion both located at the first fluid outlet, wherein the plurality of flow structures are arranged to cause a temperature of the first portion to be substantially equal to a temperature of the second portion.

7. The fluid-to-fluid heat exchanger matrix of claim 1, wherein the first plate further comprises:

a first portion and a second portion both located at the first fluid outlet, wherein the plurality of flow structures are arranged to minimize an occurrence of a temperature of the first portion that is lower than a temperature of the second portion.

8. The fluid-to-fluid heat exchanger matrix according to claim 1, wherein the plurality of flow structures includes a plurality of protrusions and recesses arranged in the first flow channel.

9. The fluid-to-fluid heat exchanger matrix of claim 8, wherein the first plate further comprises: a first portion and a second portion both located at the first flow outlet, wherein the densities of the plurality of protrusions and plurality of recesses are arranged to cause a temperature of the first portion to be substantially equal to the temperature of the second portion.

10. The fluid-to-fluid heat exchanger matrix of claim 8, wherein the first plate further comprises:

a first portion of the first plate and a second portion of the first plate both located at the first flow outlet, wherein the plurality of protrusions are arranged to control at least one of a direction of an adjacent fluid stream and a velocity of an adjacent fluid stream to control a temperature at the first plate portion and the second plate portion.

11. The fluid-to-fluid heat exchanger matrix according to claim 1, wherein a first region and a second region of the second surface of the first plate are in fluid communication such that the hot fluid is directed to flow preferentially in the second region as compared to the first region.

12. The fluid-to-fluid heat exchanger matrix according to claim 1, wherein a first region of the second surface of the first plate is immediately adjacent to an exit plane defined by the first flow outlet and a second region of the second surface of the first plate is distal to the exit plane.

13. The fluid-to-fluid heat exchanger matrix of claim 1, wherein a second region of the second surface of the first plate is immediately adjacent to an entry plane defined by the second flow inlet, and a first region of the second surface of the first plate is distal to the entry plane.

14. The fluid-to-fluid heat exchanger matrix according to claim 1, wherein the first flow channel is adapted to accommodate a flow of a fluid in a first direction and the second flow channel is adapted to accommodate a flow of a fluid in a second direction substantially perpendicular to the flow in the first direction.

15. A method for equalizing hot fluid exit plane plate temperatures in the fluid-to-fluid heat exchanger matrix of claim 1, the method comprising varying a velocity of the fluid passing through at least one of the first and second flow channels whereby a temperature of at least one of the first and second surface of the first plate or the second plate, or the first surface of the third plate, is substantially even across at least one of the first and second flow outlets.

16. The method for equalizing hot fluid exit plane plate temperature according to claim 15, the method further comprising varying the velocity of at least one of the fluids passing through the first and second flow channels, whereby a temperature at a point among a plurality of points on at least one of the first and second surface of the first plate or the second plate, or the first surface of the third plate, is substantially equal to another point across at least one of the first and second flow outlets of the same surface.

17. The method for equalizing hot fluid exit plane plate temperature according to claim 15, the method further comprising:

increasing a local velocity of the hot fluid passing through the first flow channel to optimize a heat transfer coefficient of the hot fluid; and decreasing a local velocity of the cold fluid passing through the second flow channel to optimize a heat transfer coefficient of the cold fluid, whereby the formation of cold spots on at least one of the first and second surface of the first plate or the second plate, or the first surface of the third plate, is minimized.

18. The method for equalizing hot fluid exit plane plate temperature according to claim 15, further comprising:

varying a velocity distribution of the hot fluid across the first flow channel such that the velocity of the hot fluid in a first region of the second surface of the first plate immediately adjacent to the second flow inlet is higher than the velocity of the hot fluid in a second region of the first flow channel that is immediately adjacent to the second flow outlet, wherein the first region and the second region are in fluid communication.

19. A heat exchanger comprising the fluid-to-fluid heat exchanger matrix according to claim 1.

20. A method of minimizing an occurrence of low temperature points on the fluid-to-fluid heat exchanger matrix of claim 1, the method comprising:

determining the density of the plurality of flow structures of at least one of the first flow channel or the second flow channel to control at least one of the velocity or a direction of the fluid passing through the first flow channel or second flow channel, respectively; and arranging the plurality of flow structures of the first flow channel to control the at least one of the velocity or the direction of the fluid.

21. The method of minimizing an occurrence of low temperature points on a plate of the heat exchanger matrix according to claim 15, further comprising:

arranging the plurality of flow structures of the first flow channel to control the fluid by controlling at least one of the velocity and the direction of the flow to optimize a thermal energy transfer efficiency of the heat exchanger matrix.

22. The method of minimizing an occurrence of low temperature points on a plate of the heat exchanger matrix according to claim 20, the method further comprising:

determining the density of the plurality of flow structures of at least one of the first flow channel or the second flow channel to control at least one of the velocity or the direction of the fluid passing through the first flow channel or second flow channel, respectively;

arranging the variable flow structures of the second flow channel to control at least one of the velocity or the direction of the fluid whereby a heat transfer coefficient of the fluid is optimized.

23. The method of minimizing an occurrence of low temperature points on a plate of a fluid-to-fluid heat exchanger matrix according to claim 20, wherein the density of the plurality of flow structures gradually changes from a first region to a second region of the first flow channel.

24. The method of minimizing an occurrence of low temperature points on a plate of a fluid-to-fluid heat exchanger matrix according to claim 20, wherein the density of the variable flow structures gradually changes from a first region to a second region of the second flow channel.

* * * * *